United States Patent [19]

Eskeli

[11] 4,012,164

[45] Mar. 15, 1977

[54] ROTOR WITH RECIRCULATION

[76] Inventor: Michael Eskeli, 7994-41 Locke Lee, Houston, Tex. 77042

[22] Filed: Nov. 28, 1975

[21] Appl. No.: 636,310

Related U.S. Application Data

[63] Continuation-in-part of Ser. No. 501,064, Aug. 27, 1974, Pat. No. 3,939,661.

[52] U.S. Cl. ..... 415/53 R; 415/80

[51] Int. Cl.[2] ..... F04D 5/00

[58] Field of Search ..... 415/80, 52, 53; 60/482; 416/179

[56] References Cited

UNITED STATES PATENTS

| | | | |
|---|---|---|---|
| 3,751,178 | 8/1973 | Paugh | 415/56 |
| 3,761,195 | 9/1973 | Eskeli | 415/80 |
| 3,869,220 | 3/1975 | Tayler | 415/56 |
| 3,879,152 | 4/1975 | Eskeli | 415/80 |
| 3,939,661 | 2/1976 | Eskeli | 60/682 |

*Primary Examiner*—Henry F. Raduazo

[57] ABSTRACT

A method and apparatus for generating power and for pumping fluids, wherein a free vortex cavity, within a rotating rotor, is used to pressurize a fluid after which the fluid may be used as a pressurized fluid or be used to generate power. The working fluid is injected into the free vortex cavity through feed nozzles oriented to discharge the working fluid forwardly in the direction of rotation, so that the working fluid rotational speed is normally, at least in part of the cavity, greater than the rotational speed of the rotor. The working fluid is pressurized within the vortex cavity by being forced to follow a curved path. Part of the working fluid is taken near the periphery of the curved passage, and recirculated through nozzles located toward the rotor center from the periphery thus providing additional fluid flow within the free vortex cavity and improving the rotor performance. The recirculation passages may be either radial, or be curved, and the recirculation nozzles are arranged to discharge the recirculation fluid forwardly. Fluids used as the working fluid may be liquids or gases. The rotor is provided with a shaft, and is rotatably mounted.

5 Claims, 5 Drawing Figures

ROTOR WITH RECIRCULATION

CROSS REFERENCES TO RELATED APPLICATIONS

This application is a continuation-in-part application of "Power Generator," filed 8-27-74, Ser. No. 501,064 now U.S. Pat. No. 3,939,661.

BACKGROUND AND SUMMARY OF THE INVENTION

This invention is concerned with turbines and fluid pressurizers, where a free vortex is used within a rotating rotor to pressurize a working fluid.

In my previous U.S. Pat. No. 3,879,152, "TURBINE," and in U.S. Pat. No. 3,758,223, "REACTION ROTOR TURBINE," I had described turbines where a free vortex cavity within a rotating rotor is used to create a free vortex where a working fluid is pressurized by centrifugal action. These turbines have relatively high friction losses within the rotor free vortex cavity due to the necessity of using relatively small cavities in many instances, with accompanying large velocity differentials between the working fluid and the rotor wall confining the working fluid. There are various ways to help to reduce the friction loss, and one such is to increase the fluid flow. To obtain the necessary increased fluid flow, within the free vortex cavity, recirculation may be used.

It is an object of this invention to provide a method and apparatus, to pressurize fluids within a rotor cavity, and to generate power, where a portion of the working fluid flowing through said cavity is recirculated using passages built into the rotor to pass the fluid from the area near rotor periphery into forwardly discharging nozzles located inward toward rotor center from the rotor periphery. It is also the object of this invention to provide a pumping means to pressurize fluids.

DESCRIPTION OF PREFERRED EMBODIMENTS

Figure 1:
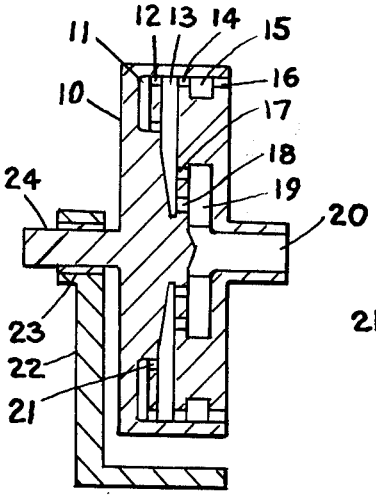
FIG. 1 is a cross section of one form of the turbine.

Referring to FIG. 1, therein is shown an axial cross section of the unit. Rotor 10 is rotatably supported by shaft 24, bearing 23 and support 22. Working fluid enters via entry port 20, and passes to spaces defined by vanes 19, and from there via nozzles 18 and 17 to free vortex cavity 13, with nozzles 17 and 18 being oriented to discharge the working fluid forwardly. After compression, part of the working fluid is recirculated via passages 12 and 11 into nozzles 21 to be injected into said cavity forwardly. Also, after compression, a part of the working fluid is passed from the vortex cavity via openings 14 to annular spaces 15, and from there discharged via passages 16, which may be nozzles oriented to discharge backward the working fluid thus generating torque on the rotor.

Figure 2:
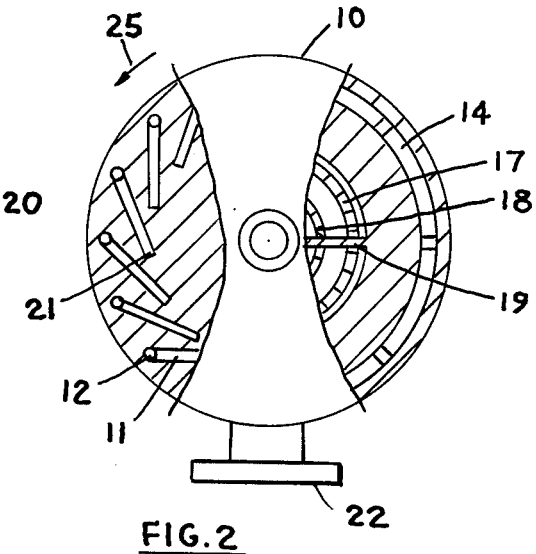
FIG. 2 is an end view of the unit shown in FIG. 1.

In FIG. 2, an end view of the unit of FIG. 1 is shown. 10 is rotor, 14 is fluid passage, 17 are nozzles, 18 are nozzles, 19 are vanes which may be radial or curved, 22 is base, 11 and 12 are fluid passages, shown here passing the fluid forward into nozzles 21, and 25 indicates direction of rotation for the rotor.

Figure 3:
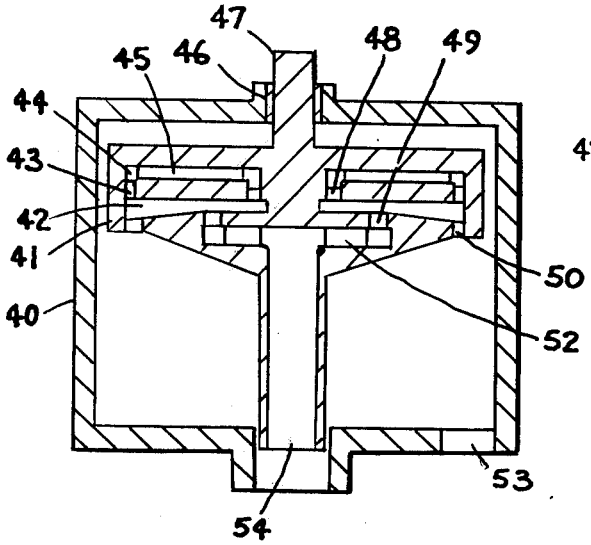
FIG. 3 is a cross section of another arrangement of the unit and FIG. 4 is an end view of the unit of FIG. 3.

In FIG. 3, another arrangement of the unit is shown, with the unit mounted within a closure for collection of the fluid leaving the rotor, and also for allowing for the pressurization of the casing if desired. 40 is casing supporting rotor bearing 46 and rotor shaft 47 and having fluid entry 54 and exit 53. Rotor is 41, having fluid passages defined by vanes 52, and nozzles 49 for feeding the working fluid from entry into rotor vortex cavity 42. After compression, part of the fluid is passed via passages 43, 44 and 45 into injection nozzles 48, and the remainder of the working fluid is passed via exit openings 50 which may be nozzles, into casing 40 and from there to discharge 53.

Figure 4:
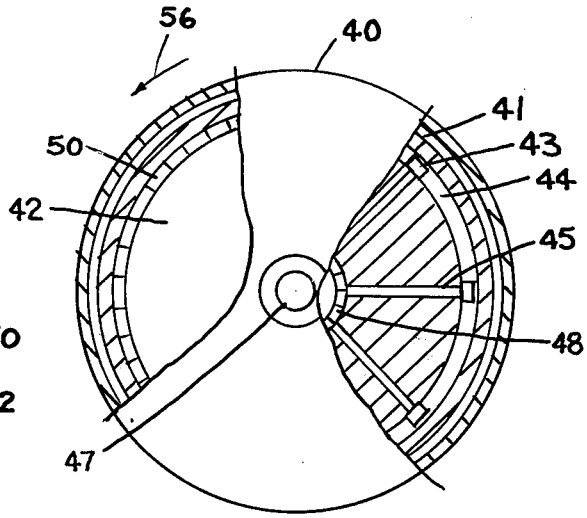

In FIG. 4, an end view of the unit shown in FIG. 3 is illustrated. 40 is casing, 41 is rotor, 43, 44 and 45 are recirculation fluid passages, 48 are recirculation nozzles, 47 is shaft, 42 is vortex cavity, 50 are exit openings, and 56 indicates a direction of rotation for the rotor.

Figure 5:
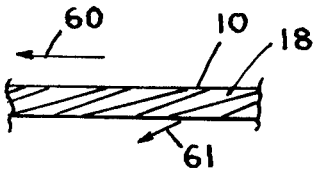
FIG. 5 is a nozzle detail.

In FIG. 5, a detail of nozzles is shown, with 60 indicating of movement, 61 of fluid leaving nozzles, 10 being rotor and 11 being the nozzles.

The operation is as indicated hereinbefore. When the unit is used as a turbine, a working fluid is passed via entry into the rotor where the working fluid is pressurized first in the entry defined by vanes 19, and then further pressurized in the vortex cavity, after which the fluid leaves via exits 16 oriented to discharge backward to generate torque on the rotor and thus generate power. Part of the fluid is circulated within the rotor as indicated to provide for improved performance.

When the unit is used as fluid pressurizer, the exit pressure from the unit is maintained at desired value, and the exit nozzles or openings 50 are made for reduced pressure drop as may be desirable.

The free vortex cavity is usually made in tapered form as shown in the drawings, to provide for desired velocity pattern within the cavity. The nozzles for recirculation may be placed as desired, and as indicated in the drawings; one or more nozzle rows may be used. Similarly, one or more rows of feeder nozzles may be used.

The working fluid recirculation passages may be radial open channels, or they may be curved in various ways, depending of the amount of pressure available within the vortex cavity.

The drawings show only a single stage for the turbine and compressor. These units may be built in multiple stages if desired, with the discharge opening, such as 50, connecting with entry side passages defined by vanes 52. By using multiple stages, larger pressure drops can be accommodated in a single rotor, and when used as a pressurizer, large delivery fluid pressures can be obtained.

Applications include power generators for liquid and gaseous fluids, and as pumps for liquids, and gas compressors. Working fluid may be either a liquid, a gas, or a liquid-gas mixture.

The working fluid is shown to be discharged from the rotor via exit nozzles, such as item 16, FIG. 1. These nozzles are shown discharging the working fluid axially away from the rotor, and tangentially backward to generate thrust, and torque on the rotor. These nozzle may be also located at the periphery to discharge radially and backward to generate said torque, and such arrangement is particularly suited for pump applications where a standard pump volute casing may be used to surround the rotor to receive the fluid being discharged by the rotor, from the peripheral nozzles.

Other types exit means for the working fluid may be also used, in place of the nozzle 16. Such means may include reaction vanes, a second rotor to generate work from the pressurized fluid being discharged from cavity 13, and other means. In my co-pending patent application "Power Generator," a second rotor is being used. Said application is Ser. No. 501,064, and was filed 8-27-74.

The fluid passages for recirculation may be also used to add additional pressure into the fluid being recirculated; this is shown in FIG. 2, passages 11, where the passages are oriented to pass the fluid in the forward direction as the rotor rotates, so that the exit opening from the passage leads the entry opening. The pressure increase within the passage depends on the placement of these passages, and their specific curvature. In this manner, one may select the pressure that is desired at exit openings 21. It should be noted, that if the passages 11 are made such that the exit opening 21 lags behind the entry 12, then there will be a pressure decrease within the passage 11, during the rotation of the rotor.

I claim:

1. A rotor for pressurizing of a fluid and comprising:

a. a fluid entry to said rotor near the center of rotation of said rotor;

b. a set of fluid nozzles for passing said fluid and oriented to discharge said fluid forwardly in the direction of rotation;

c. a vortex cavity within said rotor to receive said fluid from said fluid nozzles; for pressurizing said fluid;

d. a fluid discharge means from said vortex cavity adapted for discharging the fluid that entered the rotor through said fluid entry;

e. a fluid recirculation means for recirculating a part of said fluid from said vortex cavity into fluid recirculation nozzles; with the fluid recirculation nozzles discharging said fluid forwardly into said vortex cavity in the direction of rotation; with the recirculation nozzles being located inwardly toward rotor center from the vortex cavity area where the fluid is taken from said cavity for recirculation.

2. The rotor of claim 1 wherein said fluid discharge means are a set of fluid discharge nozzles arranged to discharge said fluid backward away from the direction of rotation.

3. The rotor of claim 1 wherein the fluid passages for recirculation fluid receive their fluid at rotor periphery.

4. In a rotor wherein a fluid is pressurized in a forced vortex confined within rotor passages, then is discharged via nozzles forwardly into a free vortex cavity within said rotor to be pressurized, and then is discharged from said rotor via exit openings, the improvement comprising:

a. a means for recirculating a portion of said fluid that is being circulated within said free vortex cavity by providing a passage for said fluid to pass a portion of the fluid circulating within said rotor into a recirculation opening arranged to discharge said fluid forwardly in the direction of rotation into said free vortex cavity, with the entry for said fluid into said passage being further away from the rotor center than said recirculation opening discharging into said free vortex cavity.

5. The rotor of claim 4 wherein said passage is arranged to pass said fluid forwardly in the direction of rotation with said recirculation opening leading the entry opening during rotation of the rotor.

* * * * *